US007722759B2

(12) United States Patent
Duke et al.

(10) Patent No.: US 7,722,759 B2
(45) Date of Patent: May 25, 2010

(54) APPARATUS, SYSTEM, AND METHOD FOR SEPARATING MINERALS FROM MINERAL FEEDSTOCK

(75) Inventors: Jay Duke, West Valley City, UT (US); Shane Duke, West Valley City, UT (US)

(73) Assignee: Pariette Ridge Development Company LLC., West Valley City, UT (US)

( * ) Notice: Subject to any disclaimer, the term of this patent is extended or adjusted under 35 U.S.C. 154(b) by 342 days.

(21) Appl. No.: 11/555,979

(22) Filed: Nov. 2, 2006

(65) Prior Publication Data

US 2007/0095076 A1 May 3, 2007

Related U.S. Application Data

(60) Provisional application No. 60/732,542, filed on Nov. 2, 2005.

(51) Int. Cl.
*F17C 13/02* (2006.01)

(52) U.S. Cl. ..... 208/390; 208/424; 422/232; 422/233

(58) Field of Classification Search ..... 208/390, 208/424; 422/232–233
See application file for complete search history.

(56) References Cited

U.S. PATENT DOCUMENTS

| | | | | |
|---|---|---|---|---|
| 140,095 | A | 6/1873 | Taylor | |
| 1,514,113 | A | 11/1924 | Trumble | |
| 2,377,136 | A | 5/1945 | Dinley et al. | 23/270 |
| 2,686,192 | A | 8/1954 | Bonotto | 260/412.8 |
| 3,131,141 | A | 4/1964 | West | 208/11 |
| 3,818,993 | A | 6/1974 | Gogarty et al. | 166/308 |
| 3,856,474 | A | 12/1974 | Pittman et al. | 23/267 R |
| 3,941,679 | A | 3/1976 | Smith et al. | 208/11 LE |
| 3,968,572 | A * | 7/1976 | Stuchberry | 34/134 |
| 3,984,920 | A * | 10/1976 | Raymond et al. | 34/134 |
| 4,029,568 | A | 6/1977 | Pittman et al. | 208/11 LE |
| 4,057,485 | A | 11/1977 | Blaine et al. | 208/11 LE |
| 4,096,057 | A | 6/1978 | Porritt et al. | 208/11 LE |
| 4,098,648 | A | 7/1978 | Kraemer et al. | 196/14.52 |
| 4,158,622 | A | 6/1979 | Schwarzenbek | 208/177 |

(Continued)

FOREIGN PATENT DOCUMENTS

| | | |
|---|---|---|
| DE | 4233584 | 9/1993 |

(Continued)

*Primary Examiner*—Glenn A Caldarola
*Assistant Examiner*—Brian McCaig
(74) *Attorney, Agent, or Firm*—Kunzler & McKenzie; David J. McKenzie

(57) ABSTRACT

An apparatus, system, and method are disclosed for separating minerals from mineral feedstock—for example bitumen from tar sand. The apparatus includes residence chambers for contacting solvent and tar sand. The solvent-tar sand contact occurs in at least two stages. The drained miscella from the first stage is sent to a flashing module to separate the miscella into recovered solvent, a bitumen stream, and a volatile hydrocarbons stream. Solvent is recycled from the final stage and reused in the residence chambers. An energy recovery module recovers the energy from the volatile hydrocarbons stream. A solvent stripper removes the solvent residue from the drained tar sand to create a cleaned sand stream, and the solvent stripper recycles the solvent vapors to energize and assist the separation process. The apparatus enables a water-free, energy efficient, and nearly complete recovery of bitumen from tar sand.

18 Claims, 8 Drawing Sheets

U.S. PATENT DOCUMENTS

| | | | | |
|---|---|---|---|---|
| 4,174,263 | A | 11/1979 | Veatch et al. | 208/11 LE |
| 4,217,202 | A | 8/1980 | Paraskos et al. | 208/11 LE |
| 4,326,968 | A | 4/1982 | Blair, Jr. | 252/8.55 D |
| 4,331,561 | A | 5/1982 | Luciani et al. | 252/429 B |
| 4,342,639 | A | 8/1982 | Gagon | 208/11 LE |
| RE31,241 | E | 5/1983 | Klaila | 431/11 |
| 4,387,016 | A | 6/1983 | Gagon | 208/11 LE |
| 4,432,865 | A | 2/1984 | Norman | 208/183 |
| 4,448,667 | A | 5/1984 | Karnofsky | 208/11 LE |
| 4,481,099 | A | 11/1984 | Mitchell | 208/11 LE |
| 4,528,090 | A | 7/1985 | Tsui | 209/2 |
| 4,532,024 | A | 7/1985 | Haschke et al. | 208/11 LE |
| 4,572,777 | A | 2/1986 | Peck | 208/11 LE |
| 4,584,087 | A | 4/1986 | Peck | 208/11 LE |
| 4,596,651 | A | 6/1986 | Wolff et al. | 208/390 |
| 4,610,729 | A | 9/1986 | Keane | 134/25.1 |
| 4,698,148 | A | 10/1987 | Keane | 208/390 |
| 4,704,200 | A | 11/1987 | Keane | 208/390 |
| 4,725,350 | A | 2/1988 | Smith | |
| 4,822,481 | A | 4/1989 | Taylor | 208/390 |
| 4,906,355 | A | 3/1990 | Lechnick et al. | 208/390 |
| 4,985,083 | A | 1/1991 | Sogaard | 134/26 |
| 5,055,180 | A | 10/1991 | Klaila | 208/402 |
| 5,092,983 | A | 3/1992 | Eppig et al. | 208/323 |
| 5,207,953 | A | 5/1993 | Thorssen et al. | 252/601 |
| 5,220,180 | A | 6/1993 | Vali et al. | 250/577 |
| 5,352,275 | A | 10/1994 | Nath et al. | 95/117 |
| 5,383,353 | A | 1/1995 | Marrelli et al. | 73/61.43 |
| 5,534,136 | A | 7/1996 | Rosenbloom | 208/390 |
| 5,998,640 | A | 12/1999 | Haefele et al. | 554/12 |
| 6,207,044 | B1 | 3/2001 | Brimhall | 208/390 |
| 6,343,507 | B1 | 2/2002 | Felling et al. | 73/152.19 |
| 6,346,888 | B1 | 2/2002 | Conrad et al. | 340/606 |
| 6,709,573 | B2 | 3/2004 | Smith | |
| 2001/0000001 | A1 | 3/2001 | Clark et al. | 134/31 |
| 2003/0127226 | A1 | 7/2003 | Heins | 166/303 |
| 2004/0058052 | A1 | 3/2004 | Ulrich et al. | 426/629 |
| 2005/0161372 | A1 | 7/2005 | Colic | 208/391 |
| 2005/0173305 | A1 | 8/2005 | Smith | |
| 2008/0053813 | A1 | 3/2008 | Cauley et al. | |

FOREIGN PATENT DOCUMENTS

| | | |
|---|---|---|
| SU | 981353 | * 12/1982 |

* cited by examiner

APPARATUS, SYSTEM, AND METHOD FOR SEPARATING MINERALS FROM MINERAL FEEDSTOCK

CROSS-REFERENCES TO RELATED APPLICATIONS

This application claims the benefit of U.S. Provisional Patent Application No. 60/732,542 entitled "Apparatus, system, and method for separating minerals from mineral feedstock" and filed on Nov. 2, 2005 for Jay and Shane Duke, which is incorporated herein by reference.

BACKGROUND OF THE INVENTION

1. Field of the Invention

This invention relates to solvent-based separation of minerals from mineral feedstock, and more particularly relates to extracting bitumen from tar sands.

2. Description of the Related Art

Separation of bitumen from tar sands is known in the current art. The currently available technologies suffer from a number of drawbacks—low yield of bitumen recovery, environmental issues with waste water disposal, environmental issues with sand disposal, release of solvent vapors to the atmosphere, release of hydrocarbons to the atmosphere, sensitivity to clays, sensitivity to oil-wet tar sands, generation of emulsions during separation, high energy input, clogging of sand draining screens, and clogging of the valves that manage counter-current flow.

Most of the processes used in the current art are some variation of the Clark hot water process. One common variation of this process is to run mineral feedstock up a a partially vertical screw feeder. The mineral feedstock is run through a solvent layer, then a water layer.

The solvent-hydrocarbon miscella formed is denser than water and must be extracted below the water layer. The fluid levels and extraction rates must be carefully controlled, or water will be drawn into the miscella extraction apparatus. The fluid layers are not stable in such systems. Any hydrocarbons that are in a miscella without enough solvent portion will float to the top of the contact chamber. This means that some hydrocarbon will be floating to the top of the system regardless of the design, and that the extracted miscella must be solvent-rich rather than hydrocarbon-rich so that the miscella doesn't float. The separation of solvent-rich miscella is more energy intensive than the separation of hydrocarbon-rich miscella.

An additional water layer serves as a cap to contain the organic solvent in the solvent-sand mixing chamber of such systems. That exposes the sand-solvent mixture to water. Water exposure of the sand-solvent mixture can swell clays, flocculate the mineral feedstock, and create emulsions within the sand-solvent mixture. All of these effects complicate the separation process.

The process allows only a single solvent-feedstock contact, the solvent-hydrocarbon miscella composition must be kept within a narrow range of compositions, and the waste water from these systems cause environmental complications. Overall, this process provides an inflexible solvent contact method and produces low bitumen recovery from the mineral feedstock—typically on the order of 50%.

Another process in the current art is to run mineral feedstock up a partially vertical screw feeder and run solvent without water in counter flow with the sand. Solvent flow is usually controlled in these systems with reed valves that get plugged, and stuck partially open with sand and are therefore high maintenance. Another solvent flow control employs tortuous slots in the flights of the screw feeder which allow liquid but not solids to pass. This mechanism complicates control of the contact time of the solvent with the mineral feedstock, and the contact times between the solvent and the mineral feedstock tend to be short as the solvent gravity feeds through the system. In addition, the slots become clogged with fines from the mineral feedstock. The clogging causes poor solvent-feedstock contact, and is a complicated maintenance problem to both diagnose the occurrence of the clogging, and to shut the system down to fix the clogging.

Overall, this process is a high maintenance process which produces low bitumen yields because the solvent-feedstock contact times are difficult to control. The counter flow nature of these processes is better than the single pass contact of the typical Clark hot water implementation, but is still not as controllable. Much of the solvent-feedstock contact occurs at the end of the system where the miscella is hydrocarbon-rich. Consequently, this solvent-feedstock contact is low quality, and these systems must be large or they must be designed for a low hydrocarbon yield.

Another process in the current art is to run mineral feedstock along a continuous belt, while spraying solvent onto the sand at various points along the belt. The solvent picks up some fraction of the hydrocarbon material and drains through perforations in the belt. This process allows multiple contacts between fresh solvent and feedstock, but the contact occurs in a static feedstock environment, the contact time is minimal, and the contact time cannot be controlled because it relies on gravity. Because only limited amounts of hydrocarbon are stripped by the solvent, the process requires some combination of: significant amounts of fresh solvent, pumping significant amounts of recycled solvent, a large conveyor system, or a design for a low hydrocarbon yield. Further, the perforations in the belt tend to plug with fines from the mineral feedstock. The plugging of the perforations is a complicated maintenance problem to both diagnose the occurrence of the plugging, and to shut the system down to fix the plugging.

Finally, the current art depends upon passive containment to prevent escape of solvent vapors to the atmosphere. Typically, a water layer is kept on top of all otherwise exposed solvent layers. Where water is not used, solvent is exposed to the atmosphere through the sand feeder.

The state of the current art is perhaps best highlighted by the fiscal year 2005 United States Department of Energy solicitations for new technologies. Technical topic 12(d) is a request for Tar Sands and Oil Shale Development, wherein the Department requests a technology that leaves clean sands, leaves low organic content in the waste water, does not release excessive volatiles to the atmosphere, leaves minimal fines in the bitumen product, and that will not flocculate clays.

From the foregoing discussion, it should be apparent that a need exists for an apparatus, system, and method that separates minerals from mineral feedstock. Beneficially, such an apparatus, system, and method would produce clean sand, generate no waste water, have low atmospheric emissions, be adaptable to the clay content and wetting of the mineral feedstock, minimize mechanical complications, and have low energy input requirements.

SUMMARY OF THE INVENTION

The present invention has been developed in response to the present state of the art, and in particular, in response to the problems and needs in the art that have not yet been fully solved by currently available technologies. Accordingly, the present invention has been developed to provide an apparatus, system, and method for separating minerals from mineral feedstock that overcome many or all of the above-discussed shortcomings in the art.

An apparatus to separate minerals from mineral feedstock is disclosed. In one embodiment, the apparatus comprises a staged mineral separator comprising a plurality of walls that define at least two fluid isolation residence chambers. The separator is configured to receive a mineral feedstock. A first stage within the separator adds solvent to the residence chambers to create a first solvent-mineral feedstock slurry, maintains the solvent contact for a first specified time period, and drains the liquid portion of the slurry from the residence chambers to create a first drained mineral feedstock stream and a first stage miscella stream. A final stage within the separator adds solvent to the residence chambers to create a final solvent-mineral feedstock slurry, maintains the solvent contact for a final specified time period, rinses the slurry by adding solvent while draining the liquid portion of the slurry from the residence chambers, then continues to drain the liquid portion of the slurry from the residence chambers to create a final drained mineral feedstock stream and a final stage miscella stream.

A transition module is configured to control the rate each residence chamber travels through the stages of the staged mineral separator. The apparatus may further comprise a timing module configured to signal the transition module to adjust each of the specified time periods. A solvent stripper is configured to strip solvent from the final drained mineral feedstock stream to create a cleaned mineral feedstock stream. A miscella storage unit is configured to receive a miscella product stream and to provide a liquid flash stream, where the miscella product stream comprises the first stage miscella stream. A flashing module is configured to receive the liquid flash stream, and to provide a solvent recovery stream, a volatile byproducts stream and a final mineral product stream. The flashing module may include a first flash tank, a second flash tank, a compressor, an evaporator, and a first refrigerated condenser.

The separator may be sealed from vapor exchange with the atmosphere. The apparatus may also comprise a staging size module configured to control a travel distance of the residence chambers within each of the stages. The staging size module may comprise replaceable segments of an outer wall of the separator, each replaceable segment comprising one of a drain screen and a blank screen, and each stage comprising at least one blank screen and at least one drain screen, such that the residence chambers travel across the at least one blank screen followed by the at least one drain screen.

The staged separator may comprise a cylinder, and the plurality of walls may comprise turns of helicoid flighting disposed within the separator, wherein the flighting is coupled to an interior wall of the separator, and wherein the transition module comprises a motor configured to turn the separator about a longitudinal axis of the separator and thereby control the rate each residence chamber travels through each of the stages. The separator may be oriented horizontally.

The apparatus may further comprise at least one intermediate stage within the separator, where each intermediate stage adds a solvent to the residence chambers to create a solvent-mineral feedstock slurry, maintains a solvent contact for a specified time period associated with each intermediate stage, and drains the liquid portion of the slurry from the residence chambers to create an intermediate drained mineral feedstock stream and an intermediate stage miscella stream associated with each intermediate stage.

The solvent stripper may comprise a low temperature dryer and a high temperature dryer, where the low temperature dryer heats the final drained mineral feedstock stream to a first temperature, and where the high temperature dryer heats the final mineral feedstock stream to a second temperature. The low temperature dryer may deliver a first solvent vapor stream to the first stage, and the high temperature dryer may deliver a second solvent vapor stream to the final stage. The apparatus may further include a pressure relief valve configured to vent solvent vapor pressure above a threshold from the separator to the miscella storage unit; the miscella storage unit may further provide a solvent vapor stream and a solvent liquid stream.

The apparatus may further include an oil heater configured to provide heated oil first to a first heating jacket on the high temperature dryer, and subsequently to a second heating jacket on the low temperature dryer, and finally to a first heat exchanger to exchange heat from the oil exiting the second heating jacket to the final mineral product stream. The apparatus may further include a second heat exchanger configured to transfer heat from the cleaned mineral feedstock stream to the liquid flash stream.

The apparatus may further include a crusher, a plurality of mixers, a feed pump, and a cyclone. The crusher may be configured to crush tar sand to a nominal size and supply the crushed tar sand to the plurality of mixers. Each mixer may comprise a screw feeder and a rejection screen to intermittently provide mineral feedstock to a feed pump. The rejection screens may be configured to prevent the mixers from providing large feedstock clumps to the feed pump. The feed pump may deliver the mineral feedstock to the cyclone. The cyclone may separate a mineral feedstock fines stream from the mineral feedstock and deliver the remaining mineral feedstock to the separator.

The apparatus may further comprise a manifold that combines the final stage miscella stream and an intermediate stage miscella stream creating a solvent-rich miscella stream. The apparatus may further comprise a control valve that divides the solvent-rich miscella stream into a solvent reuse stream that recycles to the first stage and a secondary recovery stream. The apparatus may further comprise a solvent controller configured to manipulate the control valve to achieve a specified amount of solvent entering the first stage. The miscella product stream may further comprise a secondary recovery stream.

The apparatus may further comprise a densitometer configured to detect a density of the first stage miscella stream. The solvent controller may be further configured to manipulate a flow rate of solvent to the first stage to achieve a target density of the first stage miscella stream. The apparatus may further comprise a secondary recovery pump configured to add the mineral feedstock fines stream to the secondary recovery stream. The miscella product stream may further comprise the secondary recovery stream The apparatus may further comprise a second refrigerated condenser configured to receive a solvent vapor stream and to provide a volatile vapor stream and a condensed solvent stream. The volatile vapor stream may be added to a volatile byproducts stream. The condensed solvent stream may be added to the solvent recovery stream. The apparatus may further comprise an energy recovery module that receives the volatile byproducts stream and may recover energy from the volatile byproducts stream through the burning of the volatile byproducts stream in a burner to add heat to a heated oil.

A method is disclosed to separate minerals from a mineral feedstock. The method may comprise configuring a plurality of residence times corresponding to a plurality of stages in a separator. The plurality of residence times may be configured by changing an axial length of the stages in the separator, and/or by changing a rotational speed of the separator. The method further includes creating a first slurry by contacting mineral feedstock and a solvent in a residence chamber at a first stage for a first residence time, draining a liquid portion of the slurry as a first stage miscella stream. The method further includes creating a final slurry by contacting mineral feedstock and a solvent in the residence chambers at a final stage for a final residence time, and draining a liquid portion of the final slurry while adding solvent at a rinse portion of the final stage. The method may further include continuing to drain the liquid portion of the final slurry at a drain portion of the final stage to create a final stage miscella stream.

The method may further include combining the first stage miscella stream and a portion of the final stage miscella stream into a miscella product stream. The method may include delivering the miscella product stream to a miscella storage unit, and delivering a liquid flash stream from the miscella storage unit to a flashing module. The method may include separating the liquid flash stream into a final mineral product stream, a solvent recovery stream, and a volatile byproducts stream. The method may further comprise dividing the final stage miscella stream into a solvent reuse stream and a secondary recovery stream, and adding the solvent reuse stream to the first stage.

The method may further comprise a removing a mineral feedstock fines stream from the mineral feedstock and adding the mineral feedstock fines stream to the secondary recovery stream. The method may comprise heating a final drained mineral feedstock stream to a first temperature, and further heating the final mineral feedstock stream to a second temperature. The second temperature may be higher than the first temperature and higher than a boiling point of the solvent, thereby creating a cleaned mineral feedstock stream. The method further include transferring heat from a heated oil to a high temperature dryer, then transferring heat from the heated oil to a low temperature dryer, and finally transferring heat from the heated oil to the final products stream. The method may further include transferring heat from the cleaned mineral feedstock stream to the liquid flash stream.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
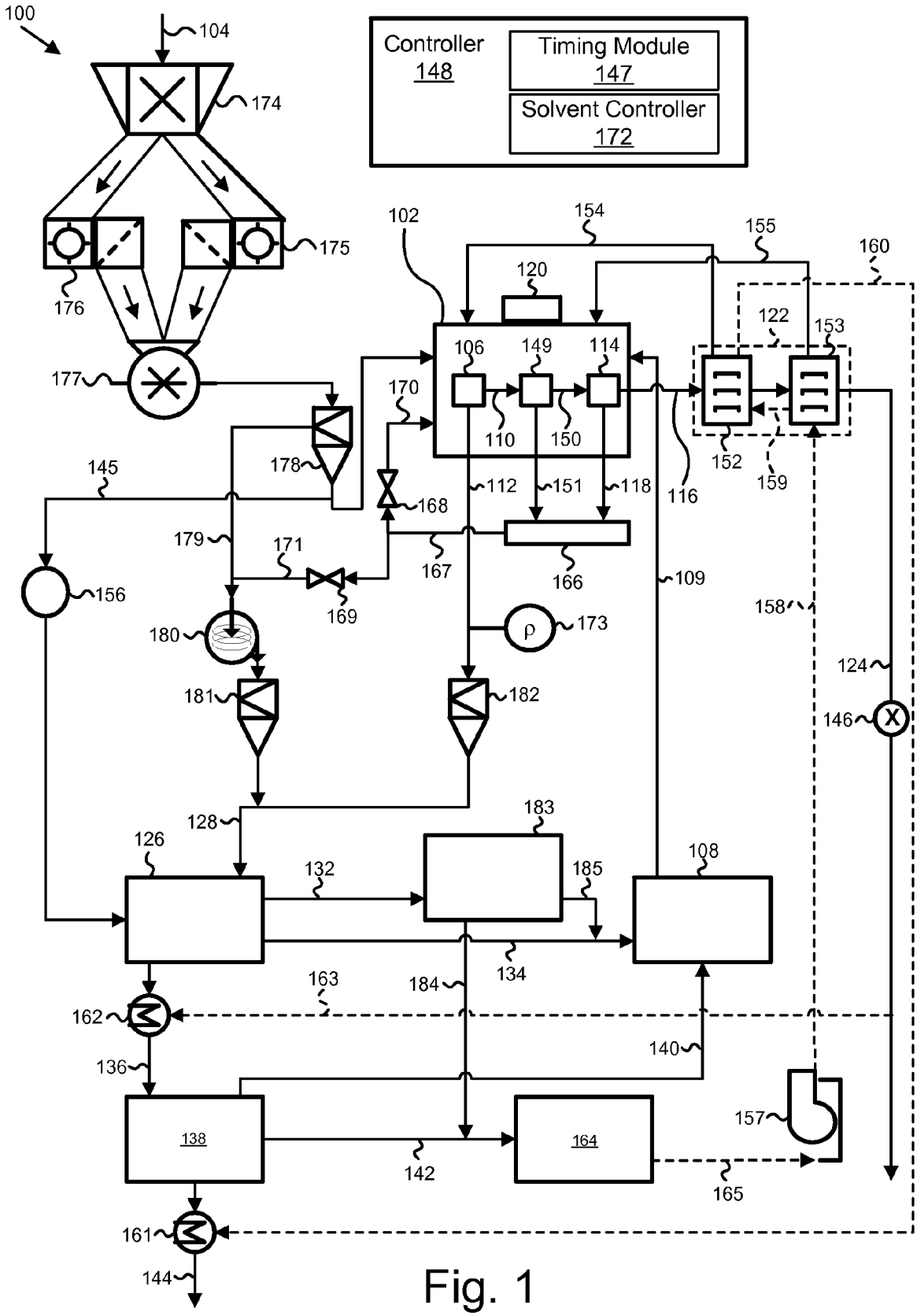
FIG. 1 is a schematic block diagram illustrating one embodiment of an apparatus to separate minerals from mineral feedstock in accordance with the present invention.

It will be readily understood that the components of the present invention, as generally described and illustrated in the figures herein, may be arranged and designed in a wide variety of different configurations. Thus, the following more detailed description of the embodiments of the apparatus, system, and method of the present invention, as presented in FIGS. 1 through 7B, is not intended to limit the scope of the invention, as claimed, but is merely representative of selected embodiments of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Throughout the figures, except as noted, dashed lines are used to represent energy transfers or energy recovery streams for the given embodiment of the invention. An energy transfer is the transferring of energy from one part of the system to another by any method, and can include at least exchanging heat through a heat exchanger, or physically mixing two streams to transfer energy. An energy recovery typically occurs in the form of thermal energy, but may be any other form of recovery including stored potential energy.

FIG. 1 is a schematic block diagram illustrating one embodiment of an apparatus 100 to separate minerals from a mineral feedstock 102 in accordance with the present invention. In one embodiment, the minerals comprise bitumen and the mineral feedstock 102 comprises a tar sand. Other mineral-feedstocks are known and contemplated within the scope of the invention, for example an oil-bearing shale. The apparatus 100 comprises a staged mineral separator 102 configured to receive a mineral feedstock 104. The separator comprises fluid isolation chambers defined by a plurality of walls separating the chambers. The chambers may be configured to travel through the separator 102. The separator 102 may be oriented horizontally, or at an incline.

The separator 102 comprises a first stage 106 within the separator 102 that adds solvent 109 to the residence chambers to create a first solvent-mineral feedstock slurry. The solvent 109 may be stored in one or more solvent tanks 108 and supplied to the separator through a pump (not shown), by gravity feed, or the like. The solvent 109 may comprise any solvent known in the art capable of dissolving the target mineral from the mineral feedstock. For example, the solvent 109 for a tar sand may comprise kerosene, naphtha, or an organic halide (an R-$X_n$compound, where R is an organic component and $X_n$ is at least one halogen molecule). In one embodiment, the solvent 109 comprises n-propyl bromide.

The first stage 106 further maintains the solvent 109 contact for a first specified time period, and drains the liquid portion of the slurry from the residence chambers to create a first drained mineral feedstock stream 110 and a first stage miscella stream 112. Miscella, as used within the present description, comprises a liquid stream with mixed components of solvent 109 and mineral product—for example bitumen.

The separator 102 further comprises a final stage 114 that adds solvent 109 to the residence chambers to create a final solvent-mineral feedstock slurry. The final stage 114 further maintains the solvent 109 contact for a final specified time period, rinses the slurry by adding solvent while draining the liquid portion of the slurry from the residence chambers. The final stage 114 continues to drain the liquid portion of the slurry to create a final drained mineral feedstock stream 116 and a final stage miscella stream 118.

The apparatus 100 further comprises a transition module 102 configured to control the rate each residence chamber travels through the stages 106, 114 of the separator 102. In an example embodiment, the separator 102 comprises a cylinder with a helicoid flighting disposed within the separator 102 and coupled to the interior walls of the separator 102. In the example, the plurality of walls defining the residence chambers comprise turns of the helicoid flighting within the separator 102. When the separator 102 turns, the residence chambers advance with the turns of the flighting. In the example, the transition module 102 may be a motor configured to turn the separator 102 about a longitudinal axis of the separator 102 and thereby control the rate each residence chamber travels through each of the stages 106, 114.

The apparatus 100 further comprises a solvent stripper 122 configured to strip solvent from the final drained mineral feedstock stream 116 to create a cleaned mineral feedstock stream 124. The apparatus 100 further comprises a miscella storage unit 126 configured to receive a miscella product stream 128, which comprises the first stage miscella stream 112. The miscella storage unit 126 provides a liquid flash stream 136.

The apparatus 100 further comprises a flashing module 138 configure to receive the liquid flash stream 136. The flashing module 138 provides a solvent recovery stream 140, a volatile byproducts stream 142, and a final mineral product stream 144. The final mineral product stream 144 may comprise bitumen from a tar sand, oil from oil shale, gold-rich effluent from a gold leaching process, and the like.

The separator 102, in one embodiment, is sealed from vapor exchange with the atmosphere. For example, on the outlet of the clean mineral feedstock stream 124, the apparatus 100 may comprise an airlock 146 configured to prevent vapor escape to the atmosphere. On the inlet side of the separator 102, a second airlock (not shown) may be used, or a feed pump 177 may comprise a positive displacement pump that prevents vapor escape to the atmosphere. The apparatus 100 may be configured to vent vapor buildup 145 in the separator 102 to a pressure relief valve 156. The pressure relief valve 156 may be configured to vent 145 vapor pressure at a threshold value from the separator 102 to the miscella storage unit 126. The overall vapor pressure within the separator 102 should be limited by the mechanical constraints of the separator 102, and potentially by leakage rates and environmental considerations for solvent vapor release—a typical venting pressure may comprise about 5 psig.

The apparatus 100 may further comprise a timing module 147 configured to signal the transition module 120 to adjust each of the specified time periods. For example, the timing module may determine that the first specified time period should change from 90 seconds to 120 seconds, and the timing module 147 may signal the transition module 120 to change a rotational rate of the separator from four RPM to three RPM.

The form of the signal to the transition module 120 is a mechanical step dependent upon the form of the apparatus 100 and a controller 148 which may comprise the timing module 147. For example, the signal could be electronic, a datalink command, or a pneumatic command. The hardware comprising the separator 102, the hardware comprising the stages 106, 149, 114 and the residence chambers, and the hardware comprising the transition module 120 will determine the type of command (e.g. RPM change, speed of a conveyor belt, etc.) and the values of the command. In one example, the separator 102 comprises a cylinder with helicoid flighting at one turn per foot, and one RPM advances the residence chambers one foot per minute. In the example, if the first stage 106 is six feet long, a turning speed of four RPM for the separator yields a first residence time of 90 seconds.

The separator 102 may comprise one or more intermediate stages 149. Each intermediate stage 149 adds solvent 109 to the residence chambers to create a solvent-mineral feedstock slurry, maintains a solvent contact for a specified period of time associated with each intermediate stage 149, and drains the liquid portion of the slurry from the residence chambers to create an intermediate drained mineral feedstock stream 150 and an intermediate stage miscella stream 151 associated with each intermediate stage 149. For example, the separator 102 may comprise two intermediate stages 149, wherein a first intermediate stage 149 is associated with a 30-second residence time and a first intermediate stage miscella stream 151, and wherein the second intermediate stage 149 is associated with a 40-second residence time and a first intermediate stage miscella stream 151.

The intermediate stages 149 allow the total residence time of all stages 106, 149, 114 to achieve enough time to remove the minerals from the mineral feedstock 104, while allowing the first stage miscella stream 112 to have a higher mineral product cut, and while allowing the solvent-consuming rinsing portion of the final stage 114 to be smaller than without the intermediate stage(s) 149. The mineral product cut refers to the fraction of the stream that is final mineral product versus solvent. For example, if the first stage miscella stream 112 is 12% bitumen, while the final stage miscella stream 118 is 3% bitumen, the first stage miscella stream has a higher mineral product cut.

In one embodiment, the sum of the residence times of all stages 106, 149, 114 is at least 180 seconds. The required residence time depends upon the specific characteristics of the solvent 104, the mineral feedstock 104, and the temperature of the slurries within the separator 102. Weaker solvents, for example kerosene, may require longer total residence times. It is a mechanical step for one of skill in the art to determine the required residence time for a given apparatus 100, and to design intermediate stages 149 to achieve the total required residence time while achieving the desired product cut in the first stage miscella stream 112 and the desired rinsing portion of the final stage 114.

The solvent stripper 122 may comprise a low temperature dryer 152 and a high temperature dryer 153 to strip solvent 109 from the final drained mineral feedstock stream 116. The low temperature dryer 152 may heat the final drained mineral feedstock stream 116 to a first temperature that drives off the bulk of the liquid solvent 109 from the final drained mineral feedstock stream 116 and pre-heats the final drained mineral feedstock stream 116. The first temperature may be a temperature near the boiling point for the solvent 109. For example, the solvent n-propyl bromide has a boiling point at atmospheric pressure of about 68 degrees C. The first temperature with n-propyl bromide may be in the range 65-100 degrees C.

The low temperature dryer 152 may be configured to deliver a first solvent vapor stream 154 to the first stage 106. In one embodiment, the first solvent vapor stream 154 may be delivered to the first stage 106 by mixing the vapor stream 154 with the mineral feedstock 104 coming into the separator. In an embodiment where the separator 102 is sealed from vapor exchange with the atmosphere, the vapor stream 154 should be added to the apparatus 100 at any position upstream of the sealing mechanism—for example, a positive displacement feed pump 177.

The solvent vapor stream 154 transfers energy from the low temperature dryer 152 to the first stage 106 resulting in a warmer slurry within the residence chambers. The warmer slurry makes the solvent stripping process more efficient as measured by time and solvent usage. The selected value for the first temperature utilized in the low temperature dryer 152 is determined from apparatus 100 specific considerations. For example, the amount of vapor 154 recycled to the first stage 106, the amount of heat energy that should be transferred from the dryer 152 to the first stage 106, the allowable vapor pressure within the separator 102 by a pressure relief valve 156, the most efficient energy burden between the low temperature dryer 152, the high temperature dryer 153 to achieve the required solvent concentrations in the cleaned mineral feedstock stream 124, and the like. These determinations are a mechanical step for one of skill in the art based on a known solvent 109, mineral feedstock 104, and apparatus 100 hardware configuration.

The high temperature dryer 153 may heat the final drained mineral feedstock stream 116 to a second temperature that drives off solvent 109 residue from the final drained mineral feedstock stream 116 to create the cleaned mineral feedstock stream 124. The second temperature may be significantly higher than the solvent 109 boiling point at atmospheric pressure. For example, in one embodiment a second temperature for the solvent n-propyl bromide may comprise 80-135 degrees C. The second temperature has no theoretical upper limit, but the constraints and costs of the apparatus 100 may limit the second temperature because other stripping methods (for example, steam stripping) to create the cleaned mineral feedstock 124 may compete economically with drying 152, 153 at high second temperatures. The given range is for one embodiment of the apparatus 100 and an n-propyl bromide solvent 109. The high temperature dryer 153 may be configured to deliver a second solvent vapor stream 155 to the final stage 114.

The apparatus 100 may further comprise an oil heater 157 configured to provide heated oil 158 to a first heating jacket on the high temperature dryer 153, and subsequently provide the heated oil 159 to a second heating jacket on the low temperature dryer 152, and finally provide the heated oil 160 to a first heat exchanger 161 to exchange heat from the oil exiting the second heating jacket to the final mineral product stream 144. The oil heater 157 may thereby heat the high temperature dryer 153 to the second temperature, heat the low temperature dryer 152 to the first temperature, which is lower than the second temperature, and heat the final mineral product stream 144 to reduce the viscosity and required pumping work for the final mineral product stream 144. It is a mechanical step for one of skill in the art to determine initial temperatures and pumping rates for the heated oil 158, 159, 160 to achieve the various desired temperatures based on the characteristics of a given embodiment of the apparatus 100.

The apparatus 100 may further comprise a second heat exchanger 162 configured to transfer heat 163 from the cleaned mineral feedstock stream 158 to the liquid flash stream 136. The heat exchanger 162 may comprise a tube that the liquid flash stream 136 flows through, where the tube is disposed within the flow of the cleaned mineral feedstock stream 158. The cleaned mineral feedstock stream 158, in one embodiment, is heated by the high temperature dryer 153 and comprises excess heat which can be recovered through the second heat exchanger 162 to improve the effectiveness of the separation in the flashing module 138.

The apparatus 100 may further comprise an energy recovery module 164 that receives the volatile byproducts stream 142 and recovers energy from the volatile byproducts stream 142. Recovering the energy from the volatile byproducts stream 142 may comprise recovering the volatile byproducts stream 142 as stored chemical potential energy, and/or converting the volatile byproducts stream 142 to electricity—for example in a fuel cell (not shown). In one embodiment, recovering the energy from the volatile byproducts stream 142 comprises burning the volatile byproducts stream 142 and providing the subsequent heat 165 to the oil heater 157.

In one embodiment, the volatile byproducts stream 142 comprises the high end hydrocarbons from the mineral feedstock 104. The volatile byproducts stream 142 may have impurities, such as sulfur compounds or the like, that may be removed before the energy recovery module 164 recovers the energy from the stream 142. Removing the impurities from a hydrocarbon stream is a mechanical step for one of skill in the art, and the details of this (for example, using a carbon adsorption unit) are not shown to avoid obscuring aspects of the present invention.

The apparatus 100 may further comprise a manifold 166 that combines the final stage miscella stream 118 with the intermediate stage miscella stream(s) 151 into a solvent-rich miscella stream 167. The apparatus 100 may further include a control valve or valves 168, 169 that divides the solvent-rich miscella stream 167 into a solvent reuse stream 170 that recycles to the first stage 106, and a secondary recovery stream 171. The secondary recovery stream 171 may be mixed with the first stage miscella stream 112 to make the miscella product stream 128.

The apparatus 100 may further comprise a solvent controller 172 configured to manipulate the control valve(s) 168, 169 to achieve a specified amount of solvent 109, 170 entering the first stage 106. The apparatus 100 may further comprise a densitometer 173 configured to detect a density of the first stage miscella stream 112 and manipulate a flow rate of solvent 109, 170 to the first stage 106 to achieve a target density 173 for the first stage miscella stream 112.

In one embodiment, the target density of the first stage miscella stream 112 comprises a value between about 1,020 $kg/m^3$ and 1,260 $kg/m^3$. For an apparatus 100 using tar sand as the mineral feedstock 104, many solvents 109 of the organic halide have a density around 1,350 $kg/m^3$, and the bitumen in the tar sand comprises a density around 700 $kg/m^3$. In one design, the solvent controller 172 may target a bitumen cut of 5-15% in the first miscella stream 112. In another design, the solvent controller 172 may target 70-90% removal of bitumen from the tar sand in the first stage 106, with a tar sand composition of 10-20% bitument, and with a nominal solvent inlet rate 109, 170 of about 9 parts solvent to about 13 parts tar sand, by weight. The solvent controller 172 may account for the composition of the solvent reuse stream 170 by detecting the composition with a second densitometer (not shown), although only a small error is typically introduced by assuming the solvent reuse stream 170 comprises only solvent.

The target densities, tar sand compositions, stream compositions, and removal of bitumen from the tar sand in the first stage 106 are shown for illustration in one embodiment only. One of skill in the art can calculate these interrelated parameters based on the disclosures herein for a given apparatus 100 and mineral feedstock 104 by fixing the parameters that are important for a given embodiment (e.g. the mineral cut of the first stage miscella stream 112), and determining the required values for the other parameters (e.g. the required target density 173). Of course, one of skill in the art will recognize that certain parameters—such as the mineral fraction of the mineral feedstock 104—typically cannot be changed as independent variables, the calculation of required stream densities 173 and solvent flow rates 109, 170 can help a practitioner determine a range of mineral feedstocks 104 for which a given embodiment of the apparatus 100 will commercially remove the minerals.

Determining a control scheme to control the flow rate of solvent 109, 170 based on the target density 173 is within the skill of one in the art. However, the following example solvent controller description 172 is intended to clarify and expedite the determination of an appropriate solvent controller 172 scheme. For the example, the solvent 109 comprises a density higher than the density of the mineral in the mineral feedstock 104. It is a mechanical step for one of skill in the art to adjust the example where the mineral density is higher than the solvent 109 density, or where a different composition detection method is used than the density 173.

The example solvent controller 172 compares the density 173 of the first stage miscella stream 112 to the target density. If the density 173 is low, the first stage miscella stream 112 is deemed "solvent-poor" and the solvent controller 172 increases the rate of the solvent reuse stream 170 with the control valve 168. If the rate of the solvent reuse stream 170 is saturated—for example if the secondary recovery stream 171 is already zero or at a minimum imposed flow rate (e.g. the minimum to manage the mineral feedstock fines stream 179), then the rate of fresh solvent flow 109 is increased. The change rates on the solvent reuse stream 170 may be controlled by a standard feedback proportional-integral-derivative (PID) controller with appropriate tuning for response and stability.

If the density 173 is high, the first stage miscella stream 112 is deemed "solvent-rich" and the solvent controller 172 decreases the rate of fresh solvent flow 109. If the rate of fresh solvent flow 109 is saturated—i.e. zero—the solvent controller 172 may reduce the solvent reuse stream 170 by increasing the rate of the secondary recovery stream 171, if possible. If the fresh solvent flow 109 is zero and the secondary recovery stream 171 is maximized, the density 173 should return to the design level unless an error—for example a mineral-poor mineral feedstock 104—has occurred. One of skill in the art will recognize that the example solvent controller 172 is based on the solvent management principle of conserving fresh solvent 109, and can be adjusted for an apparatus 100 with a different solvent management principle—for example to maintain a minimum fresh solvent 109 flow rate.

The apparatus 100 may further comprise a crusher 174 configured to crush the mineral feedstock 104, which may be tar sand, to a ¼ inch nominal size. The crusher 174 may supply the crushed tar sand 104 to a plurality of mixers 175, 176. Each mixer 175, 176 may comprise a screw feeder and a rejection screen, and may be configured to intermittently provide mineral feedstock 104 to a feed pump 177. The use of multiple mixers 175, 176 provides a continuous delivery of mineral feedstock 104 to the feed pump 177. Each rejection screen may be configured to prevent feedstock clumps larger than about 3/16 inch from being provided to the feed pump 177 by the mixers 175, 176. Each rejection screen may require periodic cleaning.

The feed pump 177 may be a positive displacement pump that provides a vapor seal for the separator 102. The vapor seal for the separator 102 may also be an airlock (not shown) or some other feature of the apparatus 100. The feed pump 177 may be configured to deliver mineral feedstock 104 to a cyclone 178. The cyclone 178 may separate a mineral feedstock fines stream 179 from the mineral feedstock 104, and deliver the mineral feedstock 104 to the separator 102.

The apparatus 100 may comprise a secondary recovery pump 180, which may be a disc flow pump, configured to add the mineral feedstock fines stream 179 to the secondary recovery stream 171. The miscella product stream 128 may include the secondary recovery stream 171 and the first stage miscella stream 112. In one embodiment, a first hydrocyclone 181 may remove fines from the secondary recovery stream 179, and a second hydrocyclone 182 may remove fines from the first stage miscella stream 112. The addition of the mineral feedstock fines stream 179 to the relatively solvent-rich secondary recovery stream 179 may allow extra removal of minerals from the mineral feedstock fines 179. The fines 179 maybe difficult to manage in other parts of the apparatus 100, depending upon the screens, pumps, and other equipment utilized throughout the apparatus 100.

The miscella storage unit 126 may be further configured to provide a solvent vapor stream 132 and a solvent liquid stream 134. The apparatus 100 may further comprise a second refrigerated condenser 183 (refer to the description referencing FIG. 5 for one embodiment of a first refrigerated condenser) configured to receive the solvent vapor stream 132, to condense the solvent vapor stream 132, and to provide volatile vapor stream 184 and a condensed solvent stream 185. The condense solvent stream 185 may be added to the solvent recovery stream 134, and the volatile vapor stream 184 may be added to the volatile byproducts stream 142.

Figure 2:
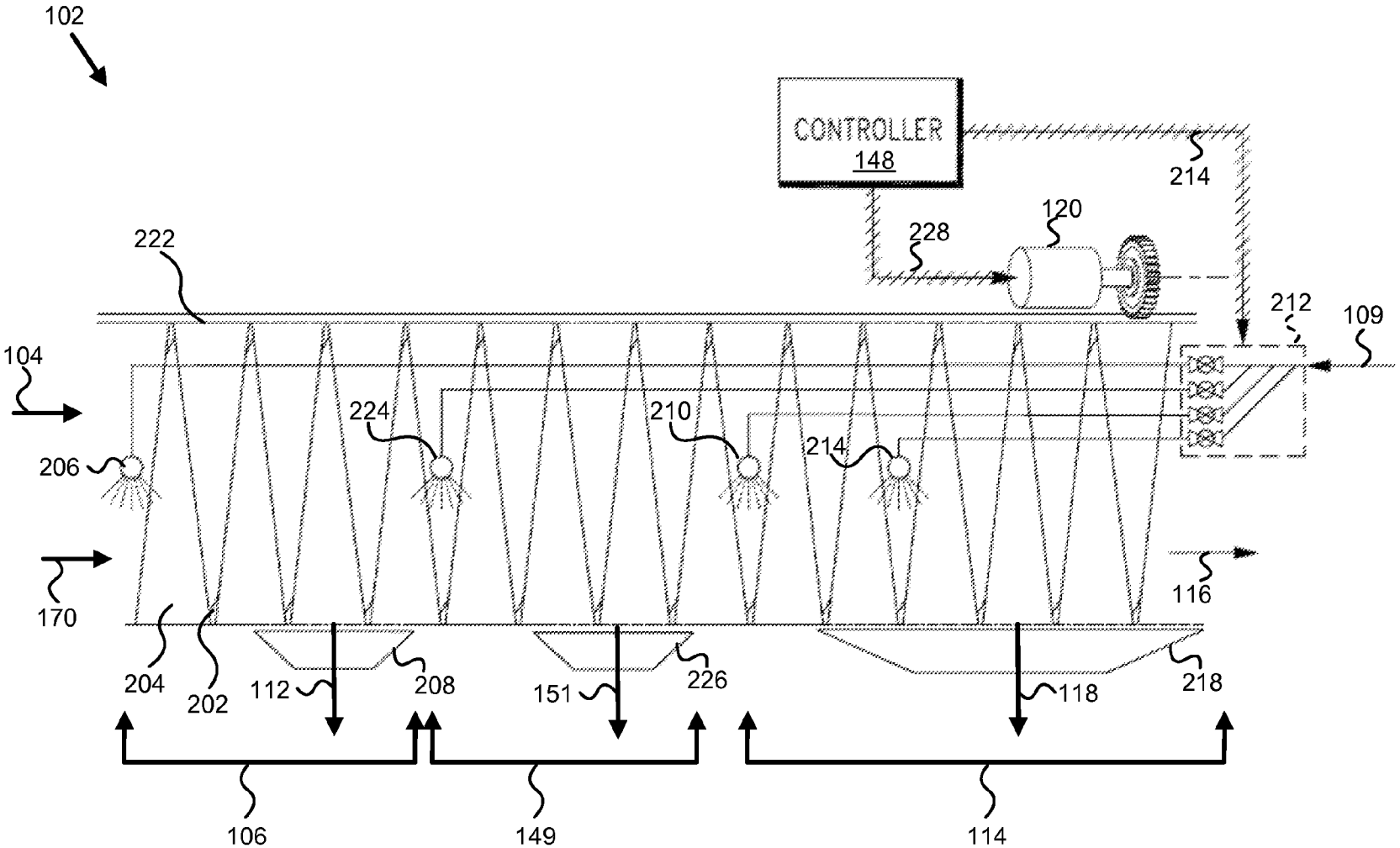
FIG. 2 is an illustration of one embodiment of a staged separator in accordance with to the present invention.

FIG. 2 is an illustration of one embodiment of a staged separator 102 in accordance with the present invention. The separator 102 comprises a plurality of walls 202 that define at least two fluid isolation residence chambers 204. The separator 102 is configured to receive a mineral feedstock 104. In one embodiment, fluid isolation indicates that liquid portions within the fluid isolation residence chambers 204 do not communicate with other residence chambers 204.

The illustrated stages 106, 149, 114 in FIG. 2 are not shown to scale but are shown only to give an example order of the stages for one embodiment of the present invention. In one embodiment, the sizing of each stage is controlled by the staging module (refer to the description referencing FIG. 4). The separator 102 may comprise a first stage 106 within the separator 102 that adds solvent 206 to a first solvent-mineral feedstock slurry, maintains the solvent contact for a first specified time period, and drains 208 the liquid portion of the slurry to create a first drained mineral feedstock stream and a first stage miscella stream 112. The separator 102 may comprise a final stage 114 within the separator 102 that adds solvent 210 to a final solvent-mineral feedstock slurry, rinses the slurry by adding solvent 214 while draining 218 the liquid portion of the slurry from the residence chambers 204, then continues to drain 218 the liquid portion of the slurry from the residence chambers 204 to create a final drained mineral feedstock stream 116 and a final stage miscella stream 118.

The separator 102 may further comprise one or more intermediate stages 149 that add solvent 224 to a first solvent-mineral feedstock slurry, maintain the solvent contact for a specified time period, and drain 226 the liquid portion of the slurry to create an intermediate drained mineral feedstock stream and an intermediate stage miscella stream 151. The solvent flow rates 206, 224, 210, 214 may be varied individually by stage via a signal from a controller 148 to one or more control valves 212. The solvent added to the first stage 106 may further comprise the solvent reuse stream 170.

In one embodiment, the staged separator comprises a cylinder, wherein the plurality of walls 202 comprise turns of helicoid flighting 202 disposed within the separator 102. The flighting 202 may be coupled to an interior wall 222 of the separator. The separator 102 may further comprise a transition module 102 that may be a motor configured to turn the separator 102 about the longitudinal axis of the separator 102 and thereby control the rate each residence chamber 202 travels through each of the stages 106, 149, 114. The apparatus 100 may comprise a controller 148 that signals 228 the transition module 120 to adjust each of the specified time periods (for the first, intermediate, and final stages).

Figure 3:
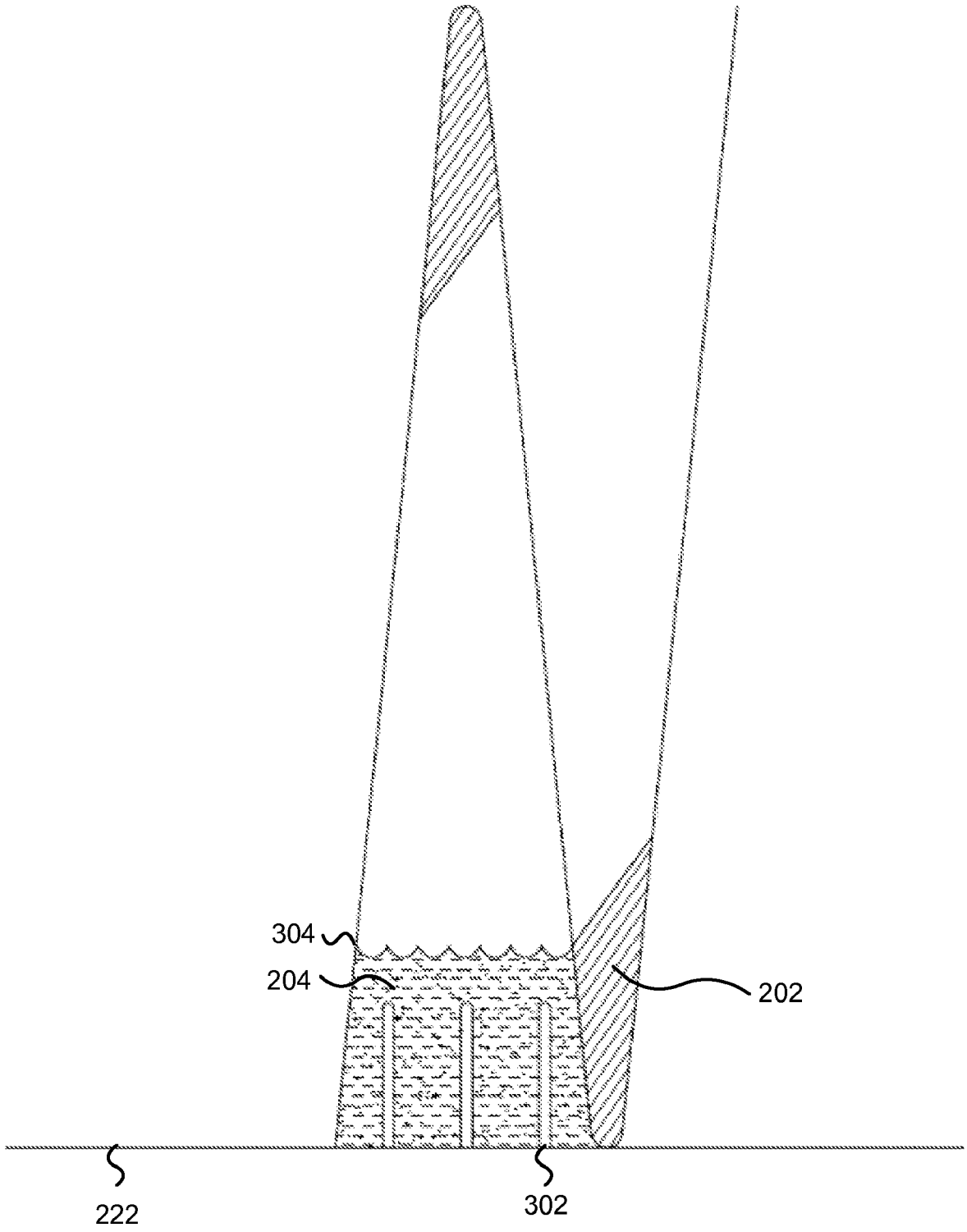
FIG. 3 is an illustration of one embodiment of a residence chamber in accordance with to the present invention.

FIG. 3 is an illustration of one embodiment of a residence chamber 204 in accordance with the present invention. The residence chamber 204 may be defined by a plurality of walls 202. A solvent-mineral feedstock slurry may be disposed within the residence chamber 204. In one embodiment, the walls 202 comprise turns of a helicoid flighting, and the slurry level 304 is limited to the vertical thickness 304 of the flighting from the separator interior wall 222 to maintain fluid isolation between residence chambers 204. The residence chambers 204 may contain agitating members 302 to prevent a liquid-solid slurry from settling.

Figure 4:
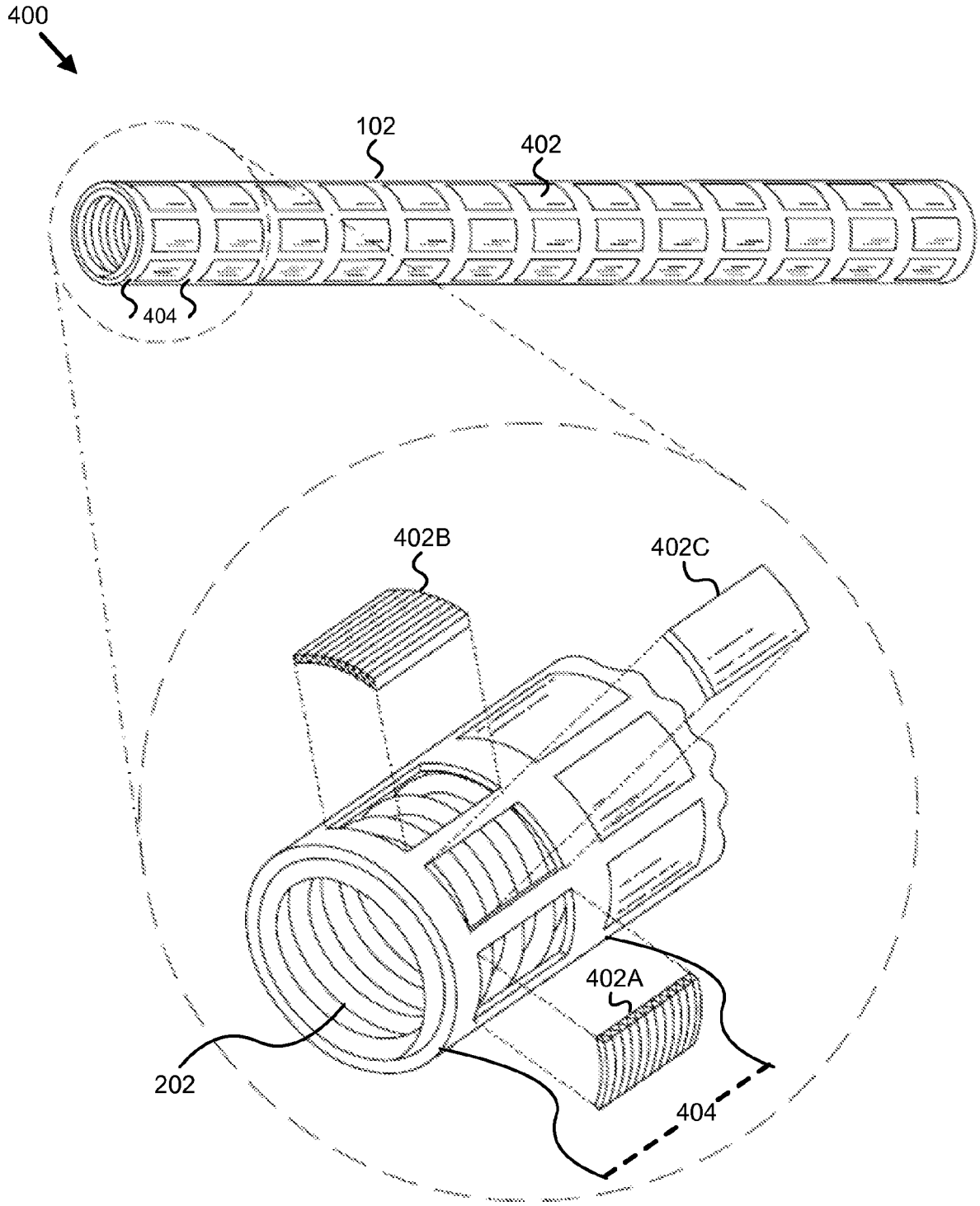
FIG. 4 is an illustration of one embodiment of a staging size module in accordance with to the present invention.

FIG. 4 is an illustration of one embodiment of a staging size module 400 in accordance with the present invention. The apparatus 100 may comprise a staging size module 400 configured to control a travel distance of the residence chambers 204 within each of the stages 106, 149, 114. In one embodiment, the staging size module 400 comprises replaceable segments 402 of an outer wall of the separator 102. Each replaceable segment 402 may comprise one of a drain screen 402A, 402B and a blank screen 402C.

Each stage 106, 149, 114 may comprise at least one blank screen 402C and at least one drain screen 402A, 402B such that the residence chambers 204 travel across the at least one blank screen 402C followed by the at least one drain screen 402A, 402B. A residence time section of a stage 106, 149, 114 may comprise blank screens 402C, while a drain section 404 of a stage 106, 149, 114 may comprise one or more drain screens 402A, 402B. The drain screens may have drain slots aligned radially 402A, axially 402B, or the drain screens may comprise holes (not shown).

The screen slot or hole sizing determines the fines content of the liquid draining 112, 151, 118 from a stage 106, 149, 114. In one embodiment, the level of fines required in the final product is about 5 micron particles or lower. An engineering economic analysis demonstrates, in one embodiment, that a hydrocyclone 181, 182 is the most economical device to reduce liquid fines from about 37-50 microns to about 5 microns, and that drain screens are the most economical device to reduce liquid fines from the bulk slurry to about 37-50 microns. The final target particulate level, and the availability and cost of fines-reducing equipment, will define the most economic equipment configurations for a particular system, and these calculations are within the skill of one in the art.

In one embodiment, the replaceable segments 402 are easily removable and comprise wing nut attachments (not shown). One of skill in the art will recognize that the separator 102 requires an outer shell as a vapor barrier (not shown) for embodiments where the separator 102 is sealed from releasing vapor to the atmosphere. The drain sections 404 should align with the associated drain 208, 226, 218 configured to accept the appropriate stage miscella stream 112, 151, 118.

Figure 5:
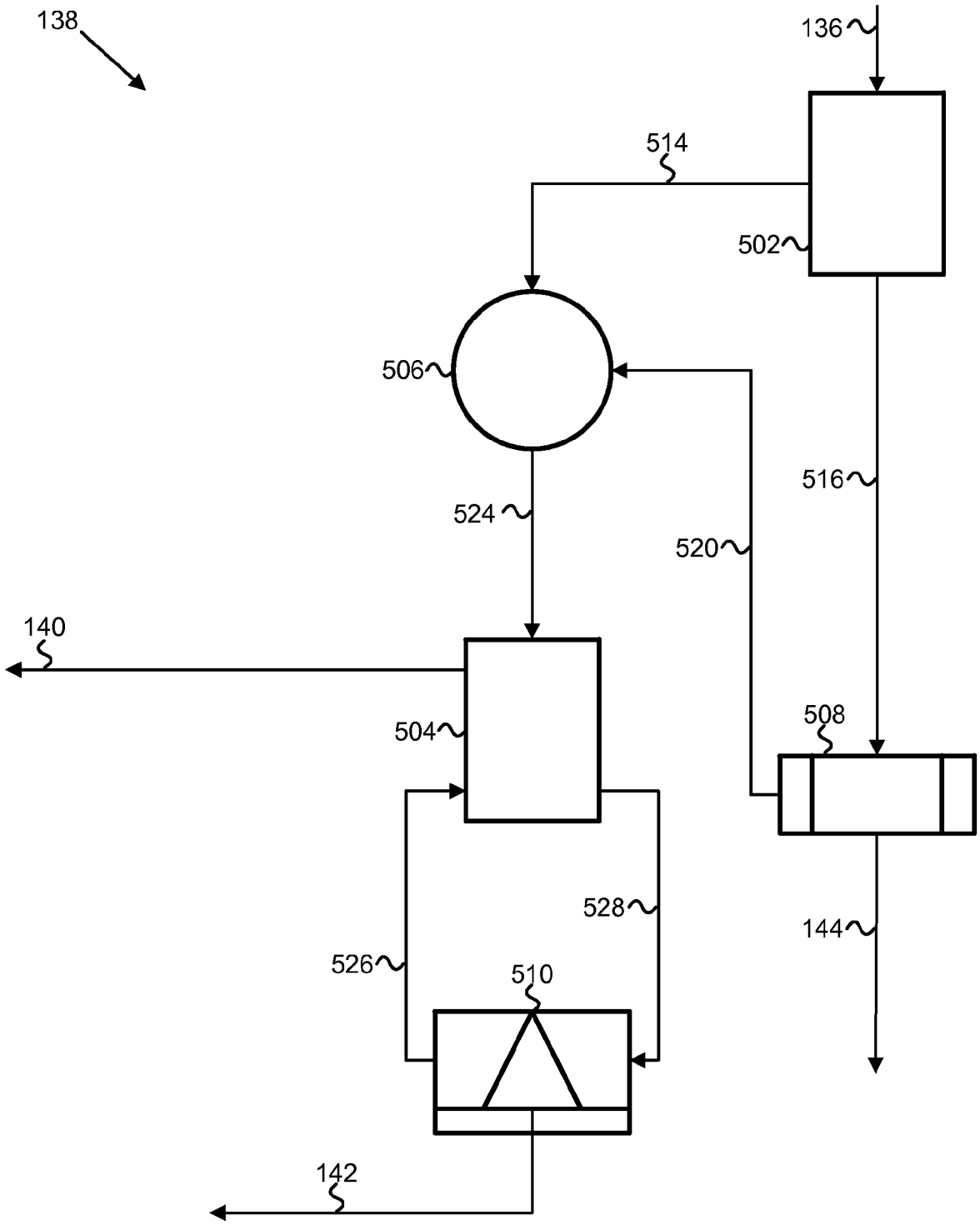
FIG. 5 is a schematic block diagram illustrating one embodiment of a flashing module in accordance with the present invention.

FIG. 5 is a schematic block diagram illustrating one embodiment of a flashing module 138 in accordance with the present invention. The flashing module 138 may comprise a first flash tank 502, a second flash tank 504, a compressor 506, an evaporator 508, and a first refrigerated condenser 510. The first flash tank 502 may receive the liquid flash stream 136 and provide a vapor stream A 514 and a liquid stream B 516. The vapor stream A 514 may comprise mostly solvent and volatile hydrocarbon byproducts. The liquid stream B 516 may comprise mostly the primary mineral product.

The evaporator 508 may receive the liquid stream B 516 and provide a vapor stream C 520 and the final mineral product stream 144. The evaporator 508 may comprise a wiped film evaporator, a falling film evaporator, or any other separation equipment known in the art to separate residual solvent 109 from the liquid stream B 516 comprising mostly primary mineral product.

The compressor 506 may receive the vapor stream A 514 and the vapor stream C 520, and provide the compressed stream 524. The second flash tank 504 may receive the compressed stream 524 and provide a vapor stream D 528 and the solvent recovery stream 140. The first refrigerated condenser 510 may receive the vapor stream D 528, and provide the volatile byproducts stream 142. The first refrigerated condenser 510 may further provide the condensed stream 526 which the second flash tank 504 receives.

Figure 6:
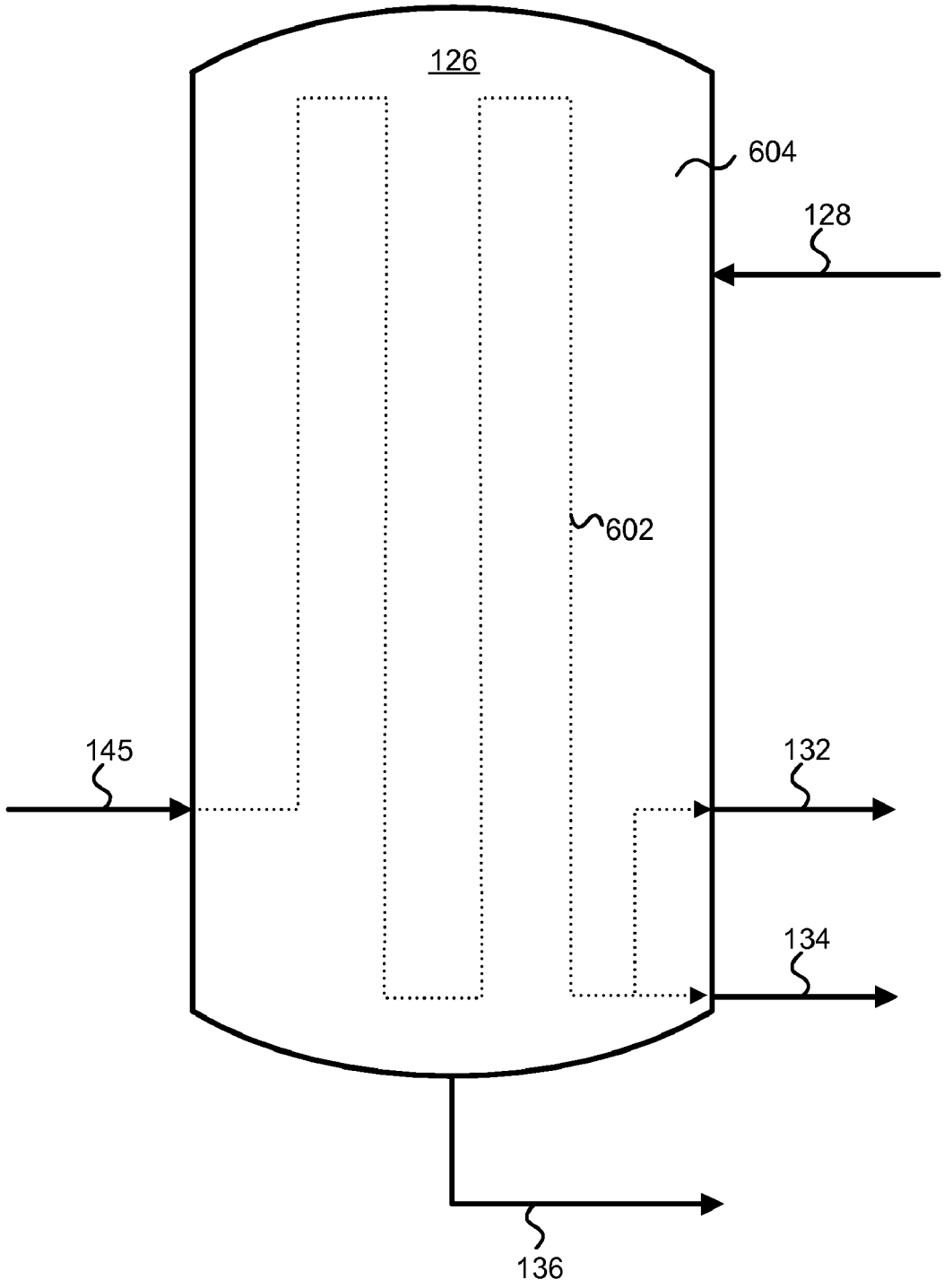
FIG. 6 is an illustration of one embodiment of a miscella storage unit in accordance with to the present invention.

FIG. 6 is an illustration of one embodiment of a miscella storage unit 126 in accordance with the present invention. The miscella storage unit 126 may comprise a shell-side 604 and a tube-side 602. The miscella storage unit 126 may receive the vented vapor 145 from the separator 102, and pass the vented vapor 145 through the miscella storage unit 126 on the tube-side 602. A fraction of the vapor 145 may condense and comprise the solvent liquid stream 134, while the remaining vapor 145 may comprise the solvent vapor stream 132. The solvent vapor stream 132 may contain volatile byproducts from the mineral feedstock, and the solvent vapor stream 132 may be passed to the second refrigerated condenser 183 to separate remaining solvent from volatile byproducts. The miscella product stream 128 may be received on the shell-side of the miscella storage unit 126, and be later provided as the liquid flash stream 136. In addition to providing the heat transfer between the solvent vapors 145 and the miscella product stream 128, the miscella storage unit 126 provides a physical buffer between the section of the apparatus 100 that separates minerals from the mineral feedstock 104 (primarily the separator 102), and the section of the apparatus 100 that separates product minerals from the solvent 109 (primarily the flashing module 400).

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 7A:
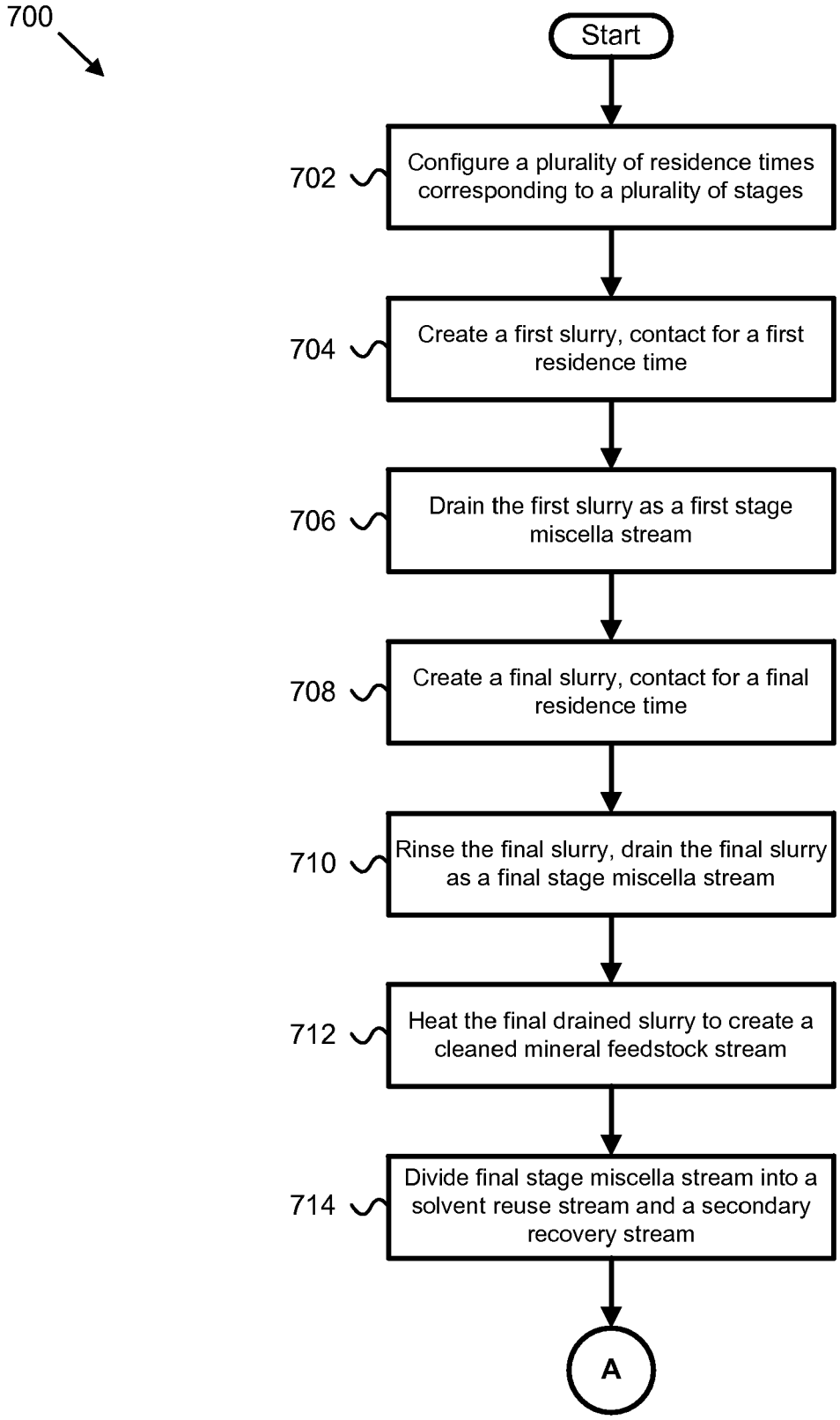
FIG. 7A is a schematic flow chart diagram illustrating an embodiment of a method for separating minerals from mineral feedstock in accordance with to the present invention.
Figure 7B:
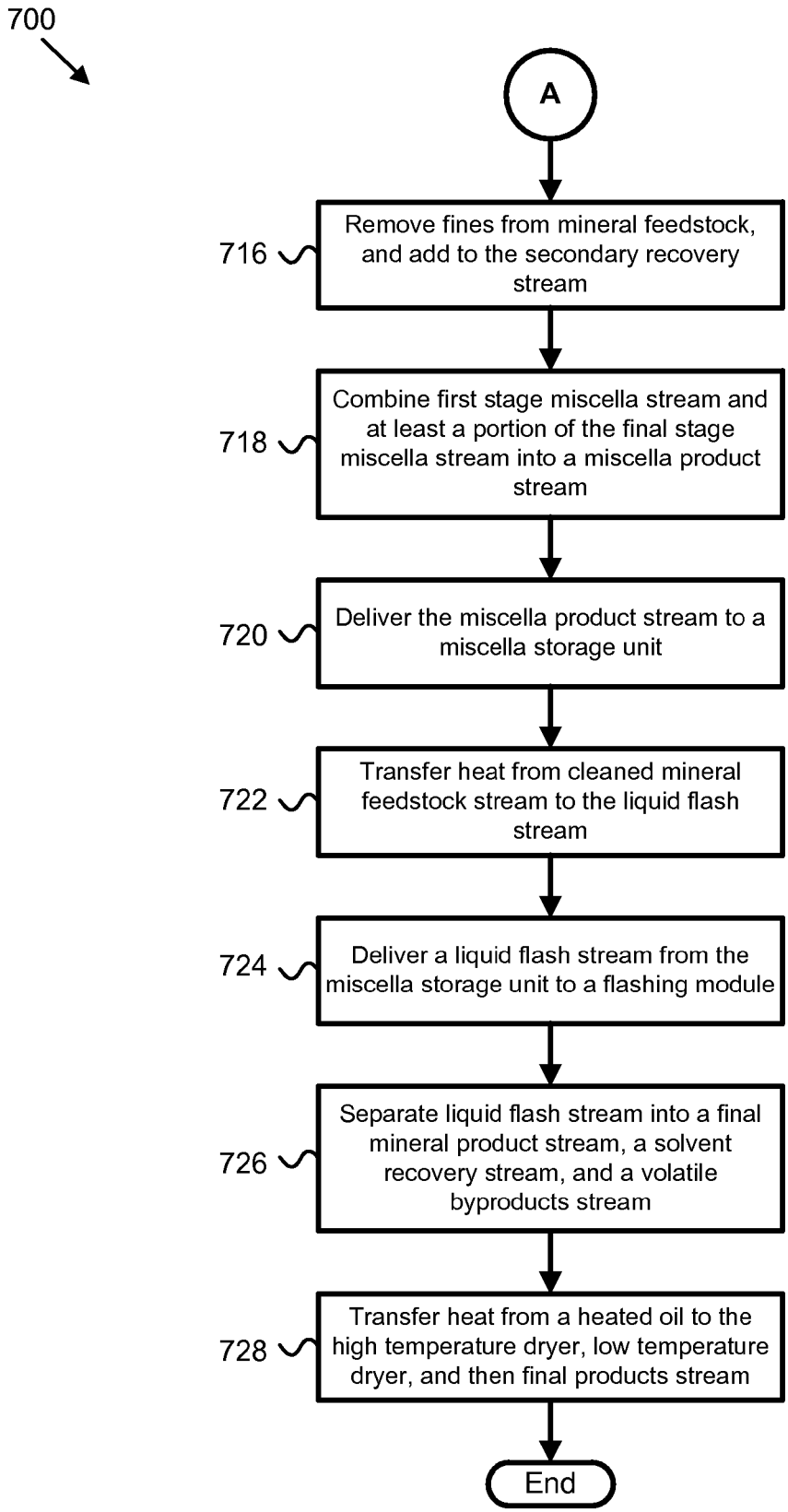
FIG. 7B is a continuation of the schematic flow chart diagram of FIG. 7A.

FIG. 7A is a schematic flow chart diagram illustrating an embodiment of a method 700 for separating minerals from mineral feedstock in accordance with to the present invention. The method 700 may begin with the timing module 147 and/or staging size module 400 configuring 702 a plurality of residence times corresponding to a plurality of stages 106, 149, 114 in a separator 102. The method 700 may continue with the separator 102 creating 704 a first slurry by contacting mineral feedstock 104 and a solvent 109 in a plurality of residence chambers 204 at a first stage 106 for a first residence time. The method 700 may continue with the separator 102 draining 706 a liquid portion of the slurry as a first stage miscella stream 112, and creating 708 a final slurry by contacting mineral feedstock and a solvent in the residence chambers 204 at a final stage 114 for a final residence time. The method 700 may continue with the separator 102 draining 710 a liquid portion of the final slurry at a rinse portion of the final stage while adding more solvent, and continuing to drain the liquid portion of the final slurry at a drain portion of the final stage as a final stage miscella stream 118.

The method 700 may include a solvent stripper 122 heating 712 the final mineral feedstock stream 116 to a first temperature, and further heating the final mineral feedstock stream 116 to a second temperature, wherein the second temperature is higher than the first temperature and higher than a boiling point of the solvent 109, thereby creating a cleaned mineral feedstock stream 124. The method 700 may include the solvent controller 172 dividing the final stage miscella stream 118 into a solvent reuse stream 170 and a secondary recovery stream 171.

The method 700 may continue (Referring to FIG. 7B) with a cyclone 178 removing 716 a mineral feedstock fines stream 179 from the mineral feedstock 104, and a secondary recovery pump 180 adding the mineral feedstock fines stream 179 to the secondary recovery stream 171. The secondary recovery pump 180 may combine 718 the first stage miscella stream 112 and at least a portion of the final stage miscella stream 118 into a miscella product stream 128, and the separator 102 and/or secondary recovery pump 180 may deliver 720 the miscella product stream to a miscella storage unit 126.

The method 700 may further include transferring 722 heat from the cleaned mineral feedstock stream 124 to the liquid flash stream 136. The flashing module 138 may separate 726 the liquid flash stream 136 into a final mineral product stream 144, a solvent recovery stream 140, and a volatile byproducts stream 142. The method 700 may further include an oil heater 157 transferring 728 heat from a heated oil to the high temperature dryer 153, then transferring heat from the heated oil to the low temperature dryer 152, and a heat exchanger 161 then transferring 728 heat from the heated oil to the final products stream 144.

The present invention provides an apparatus, system, and method for removing minerals from mineral feedstock. The present invention introduces fewer environmental complications, and is a water-free process (when water is not the solvent) that will not complicate processing of mineral feedstock containing clays. The sizing and residence times within the present invention are reconfigurable and easily scalable, and heat and energy stream managements within the process allow for an efficient separation of minerals from mineral feedstock.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to separate minerals from mineral feedstock, the apparatus comprising:

a staged mineral separator comprising a plurality of walls and a rotatable cylinder, the plurality of walls comprising turns of helicoid flighting coupled to an interior wall of the rotatable cylinder such that the plurality of walls, and the rotatable cylinder define at least two fluid isolation residence chambers, the separator configured to receive a mineral feedstock;

a first stage within the separator that adds solvent to the residence chambers to create a first solvent-mineral feedstock slurry, maintains the solvent contact for a first specified time period, and drains the liquid portion of the slurry from the residence chambers to create a first drained mineral feedstock stream and a first stage miscella stream;

a final stage within the separator that adds the solvent to the residence chambers to create a final solvent-mineral feedstock slurry, maintains the solvent contact for a final specified time period, rinses the slurry by adding solvent while draining the liquid portion of the slurry from the residence chambers, then continues to drain the liquid portion of the slurry from the residence chambers to create a final drained mineral feedstock stream and a final stage miscella stream;

a transition module configured to control the rate each residence chamber travels through the stages of the staged mineral separator; and a solvent stripper configured to strip solvent from the final drained mineral feedstock stream to create a cleaned mineral feedstock stream.

2. The apparatus of claim 1, wherein the separator is sealed from vapor exchange with the atmosphere.

3. The apparatus of claim 2, further comprising a staging size module configured to control a travel distance of the residence chambers within each of the stages.

4. The apparatus of claim 3, further comprising a timing module configured to signal the transition module to adjust each of the specified time periods.

5. The apparatus of claim 4, wherein the transition module comprises a motor configured to turn the separator about a longitudinal axis of the separator and thereby control the rate each residence chamber travels through each of the stages.

6. The apparatus of claim 5, wherein the staging size module comprises replaceable segments of an outer wall of the separator, each replaceable segment comprising one of a drain screen and a blank screen, each stage comprising at least one blank screen, and at least one drain screen, such that the residence chambers travel across the at least one blank screen followed by the at least one drain screen.

7. The apparatus of claim 4, wherein the separator is oriented horizontally.

8. The apparatus of claim 4, further comprising at least one intermediate stage within the separator, wherein each intermediate stage adds a solvent to the residence chambers to create a solvent-mineral feedstock slurry, maintains a solvent contact for a specified time period associated with each intermediate stage, and drains the liquid portion of the slurry from the residence chambers to create an intermediate drained mineral feedstock stream and an intermediate stage miscella stream associated with each intermediate stage.

9. The apparatus of claim 8, further comprising a manifold that combines the final stage miscella stream with the intermediate stage miscella stream corresponding to each of the at least one intermediate stages into a solvent-rich miscella stream, the apparatus further comprising at least one control valve that divides the solvent-rich miscella stream into a solvent reuse stream that recycles to the first stage and a secondary recovery stream, the apparatus further comprising a solvent controller configured to manipulate the at least one control valve to achieve a specified amount of solvent entering the first stage, wherein the miscella product stream further comprises the secondary recovery stream.

10. The apparatus of claim 9, further comprising a densitometer configured to detect a density of the first stage miscella stream and wherein the solvent controller is further configured to manipulate a flow rate of solvent to the first stage to achieve a target density of the first stage miscella stream, wherein the target density comprises a value between about 1020 $kg/m^3$ and 1260 $kg/m^3$.

11. The apparatus of claim 4, the solvent stripper comprising a low temperature dryer and a high temperature dryer, wherein the low temperature dryer heats the final drained mineral feedstock stream to a first temperature, and wherein the high temperature dryer heats the final mineral feedstock stream to a second temperature, wherein the second temperature is higher than the first temperature and higher than a boiling point of the solvent, the low temperature dryer configured to deliver a first solvent vapor stream to the first stage, and the high temperature dryer configured to deliver a second solvent vapor stream to the final stage, the apparatus further comprising a pressure relief valve configured to vent solvent vapor pressure above a threshold from the separator to a miscella storage unit, wherein the miscella storage unit provides a liquid flash stream, solvent vapor stream, and a solvent liquid stream.

12. The apparatus of claim 11, further comprising an oil heater configured to provide heated oil first to a first heating jacket on the high temperature dryer, and subsequently to a second heating jacket on the low temperature dryer, and finally to a first heat exchanger to exchange heat from the oil exiting the second heating jacket to the final mineral product stream, the apparatus further comprising a second heat exchanger configured to transfer heat from the cleaned mineral feedstock stream to the liquid flash stream.

13. The apparatus of claim 11, further comprising a flashing module comprising a first flash tank, a second flash tank, a compressor, an evaporator, and a first refrigerated condenser, wherein the first flash tank receives the liquid flash stream and provides a vapor stream A and a liquid stream B, wherein the evaporator receives the liquid stream B and provides a vapor stream C and a final mineral product stream, wherein the compressor receives the vapor A and the vapor stream C and provides a compressed stream, wherein the second flash tank receives the compressed stream and a condensed stream and provides a vapor stream D and a solvent recovery stream, and wherein the first refrigerated condenser receives the vapor stream D and provides the condensed stream and a volatile byproducts stream, the apparatus further comprising a second refrigerated condenser configured to receive the solvent vapor stream, and to provide a volatile vapor stream and a condensed solvent stream, wherein the volatile vapor stream is added to the volatile byproducts stream, and wherein the condensed solvent stream is added to the solvent recovery stream.

14. The apparatus of claim 13, further comprising an energy recovery module that receives the volatile byproducts stream and recovers energy from the volatile byproducts stream through a method selected from the group consisting of burning the volatile byproducts stream in a burner to add heat to the heated oil, storing the volatile byproducts stream as potential energy, and converting the volatile byproducts stream to electricity in a fuel cell.

15. The apparatus of claim 4, further comprising a crusher, a plurality of mixers, a feed pump, and a cyclone, wherein the mineral feedstock comprises tar sand, wherein the crusher is configured to crush the tar sand to about ¼ inch nominal size, and to supply the crushed tar sand to the plurality of mixers, wherein each mixer comprises a screw feeder and a rejection screen, each mixer configured to intermittently provide mineral feedstock to the feed pump and each rejection screen configured to prevent each mixer from providing feedstock clumps larger than 3/16 inch to the feed pump, wherein the feed pump delivers the mineral feedstock to the cyclone, and wherein the cyclone separates a mineral feedstock fines stream from the mineral feedstock, and delivers the mineral feedstock to the separator.

16. The apparatus of claim 15, further comprising a manifold that combines the final stage miscella stream with the intermediate stage miscella stream corresponding to each of the at least one intermediate stages into a solvent-rich miscella stream, the apparatus further comprising at least one control valve that divides the solvent-rich miscella stream into a solvent reuse stream that recycles to the first stage and a secondary recovery stream, the apparatus further comprising a solvent controller configured to manipulate the at least one control valve to achieve a specified amount of solvent entering the first stage, the apparatus further comprising a secondary recovery pump configured to add the mineral feedstock fines stream to the secondary recovery stream, wherein the miscella product stream further comprises the secondary recovery stream.

17. An apparatus to separate bitumen from tar sand, the apparatus comprising:

a crusher that crushes a tar sand stream to about ¼ inch nominal size;

a plurality of mixers, each mixer comprising a screw feeder and a reject screen, wherein the mixers deliver the screened tar sand stream to a feeder pump;

the feeder pump comprising a positive displacement pump configured to deliver the tar sand stream to a cyclone, and to seal a separator from vapor exchange with the atmosphere;

the cyclone configured to separate a tar sand fines stream from the tar sand stream, and to deliver the remainder of the tar sand stream to the separator;

a separator comprising:

a cylinder, a helicoid flighting coupled to the interior wall of the cylinder, a plurality of fluid isolation residence chambers, each fluid isolation residence chamber disposed between adjacent turns of the helicoid flighting, a first stage within the separator that adds a solvent to the residence chambers to create a solvent-tar sand slurry, maintains a solvent contact for a first specified time period, and drains the liquid portion of the slurry from the residence chambers to create a first drained tar sand stream and a first stage miscella stream;

a final stage within the separator that adds the solvent to the residence chambers to create a final solvent-tar sand slurry, maintains the solvent contact for a final specified time period, rinses the slurry by adding solvent while draining the liquid portion of the slurry from the residence chambers, then continues to drain the liquid portion of the slurry from the residence chambers to create a final drained tar sand stream and a final stage miscella stream;

a motor configured to turn the separator about the longitudinal axis of the separator and thereby control the rate each residence chamber travels through each of the stages;

a residence time controller configured to signal the transition module to adjust each of the specified time periods;

a low temperature dryer configured to strip solvent from the final drained tar sand stream, and a high temperature dryer configured to further strip solvent from the final drained tar sand stream to create a cleaned tar sand stream;

at least one control valve that divides the final liquid miscella stream into a solvent reuse stream that recycles to the first stage and a secondary recovery stream, the apparatus further comprising a solvent controller configured to manipulate the at least one control valve to achieve a specified amount of solvent entering the first stage;

a miscella storage unit configured to receive a miscella product stream, wherein the miscella product stream comprises the first liquid miscella stream combined with the secondary recovery stream, the miscella storage unit comprising a solvent vapor stream, a solvent liquid stream, and a liquid flash stream;

a first flash tank that receives the liquid flash stream and provides a vapor stream A and a liquid stream B;

an evaporator that receives the liquid stream B and provides a vapor stream C and a final bitumen product stream;

a compressor that receives the vapor stream A and the vapor stream C, and provides a compressed stream;

a second flash tank that receives the compressed stream and a condensed stream and provides vapor stream D and a solvent recovery stream; and a refrigerated condenser that receives the vapor stream D and provides the condensed stream and a volatile byproducts stream.

18. An apparatus for separating minerals from mineral feedstock, the apparatus comprising:

at least two fluid isolation residence chambers defined by a plurality of walls and a rotatable cylinder, the plurality of walls comprising turns of helicoids flighting coupled to an interior wall of the rotatable cylinder;

a first stage that contacts a solvent and a mineral feedstock in the residence chambers for a first specified time period, and that provides a first stage miscella stream and a first drained mineral feedstock;

a final stage that contacts the solvent and the first drained mineral feedstock in the residence chambers for a second time period, and that provides a final stage miscella stream and a final drained mineral feedstock;

a transition module that controls the first specified time period and the second specified time period by controlling a speed that the residence chambers travel through the first stage and the final stage;

a timing module that adjusts the first specified time period and the second specified time period by signaling the transition module to adjust each of the first specified time period and the second specified time period;

a solvent stripper configured to strip solvent from the final drained mineral feedstock to create a cleaned mineral feedstock stream; and a flashing module configured to separate the first stage miscella stream into a solvent recovery stream, a volatile byproducts stream, and a final mineral product stream.

* * * * *